United States Patent [19]

Hess et al.

[11] 4,180,884

[45] Jan. 1, 1980

[54] FINGERNAIL CLEANING APPARATUS

[76] Inventors: Don Hess; JoAnna B. Hess, both of 6100 SW. 120th St., Miami, Fla. 33156

[21] Appl. No.: 959,431

[22] Filed: Nov. 9, 1978

[51] Int. Cl.[2] ..... A46B 13/04

[52] U.S. Cl. ..... 15/21 R

[58] Field of Search ..... 15/21 R, 21 C, 21 D, 15/97 R

[56] References Cited

U.S. PATENT DOCUMENTS

| | | | |
|---|---|---|---|
| 2,424,509 | 7/1947 | Singer | 15/21 R X |
| 3,081,471 | 3/1963 | Newell | 15/21 D |
| 3,332,099 | 7/1967 | Reiter | 15/21 R |
| 3,439,370 | 4/1969 | McLaughlin | 15/21 R X |
| 3,918,117 | 11/1975 | Plante | 15/21 D |
| 4,052,766 | 10/1977 | Morrison | 15/21 C |
| 4,123,816 | 11/1978 | Lupo | 15/21 D |

*Primary Examiner*—Edward L. Roberts
*Attorney, Agent, or Firm*—Oltman and Flynn

[57] ABSTRACT

Fingernail cleaning apparatus in which a disc-shaped rotary brush is utilized in combination with cleaning liquid to obtain effective cleaning action for the fingernails. The rotary brush is mounted rotatably inside a housing, and a mouth of the housing is closed by a guide assembly which forms entrances for only the fingers to be received in the housing. Liquid is received in the housing. The guide assembly includes sealing structure for sealing around the fingers to prevent escape of liquid. The rotary brush is driven by a motor.

8 Claims, 8 Drawing Figures

FIG. 1
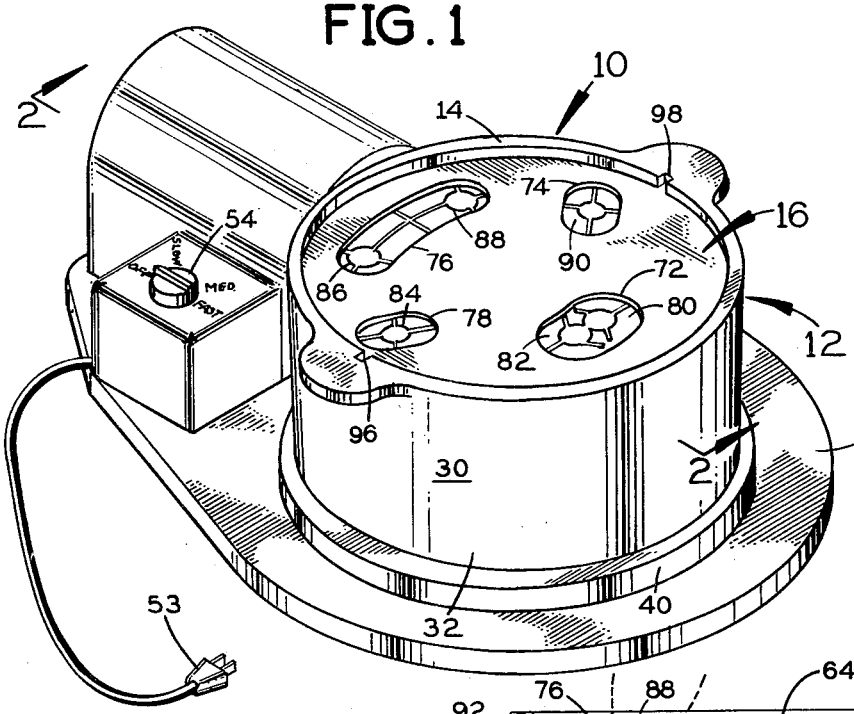
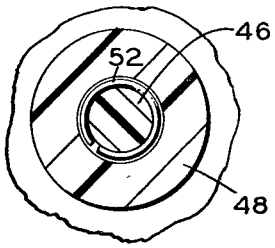
FIG. 4
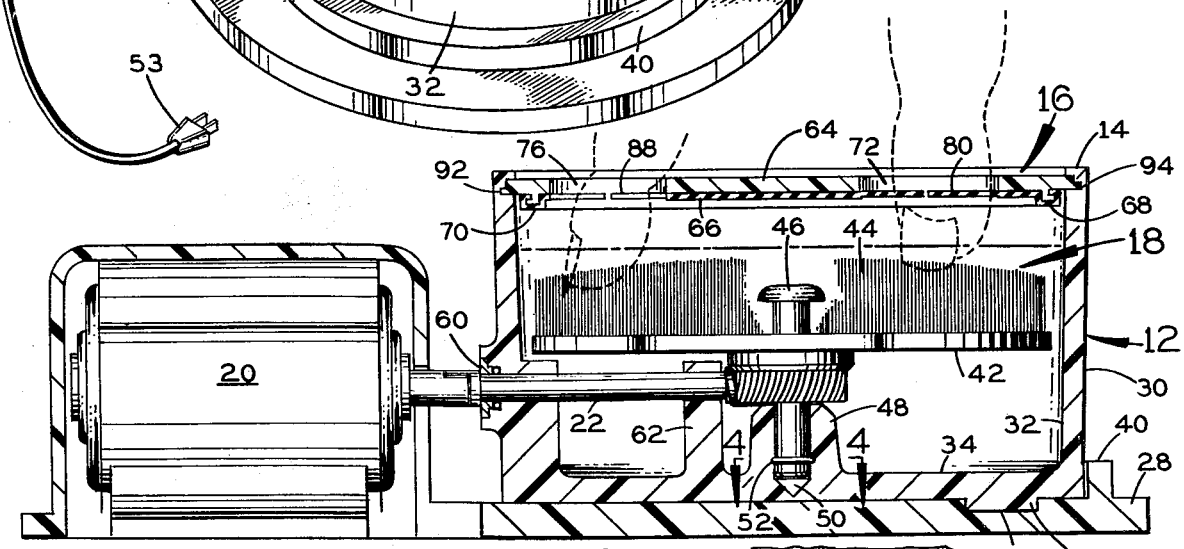
FIG. 2
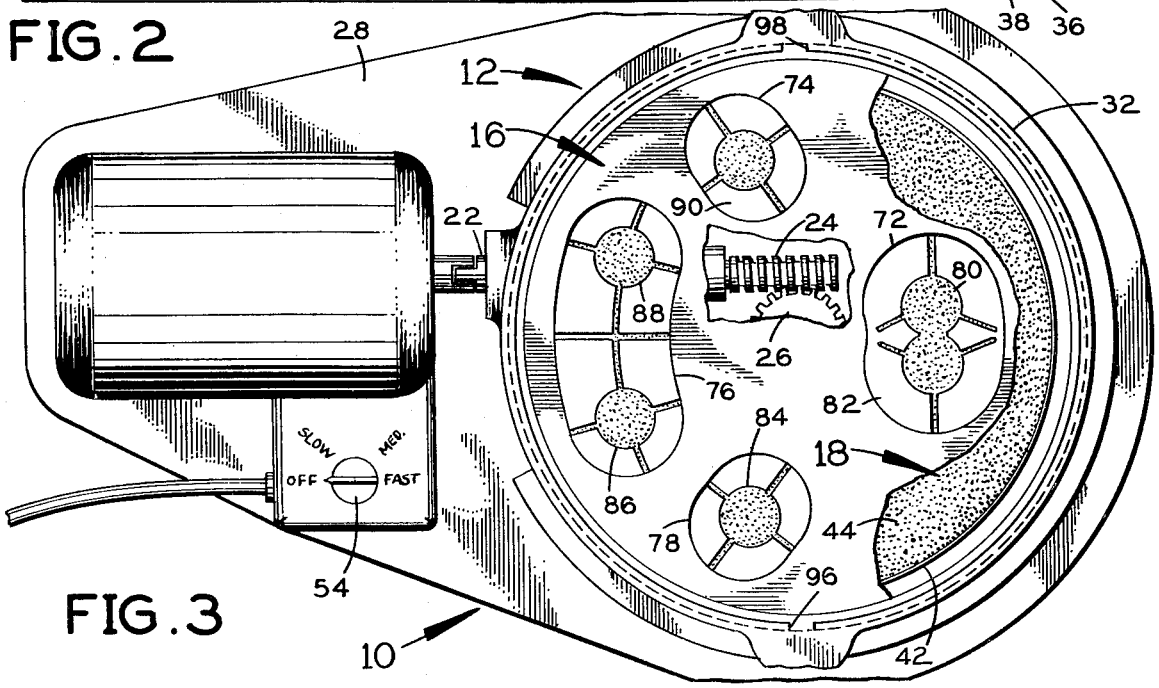
FIG. 3

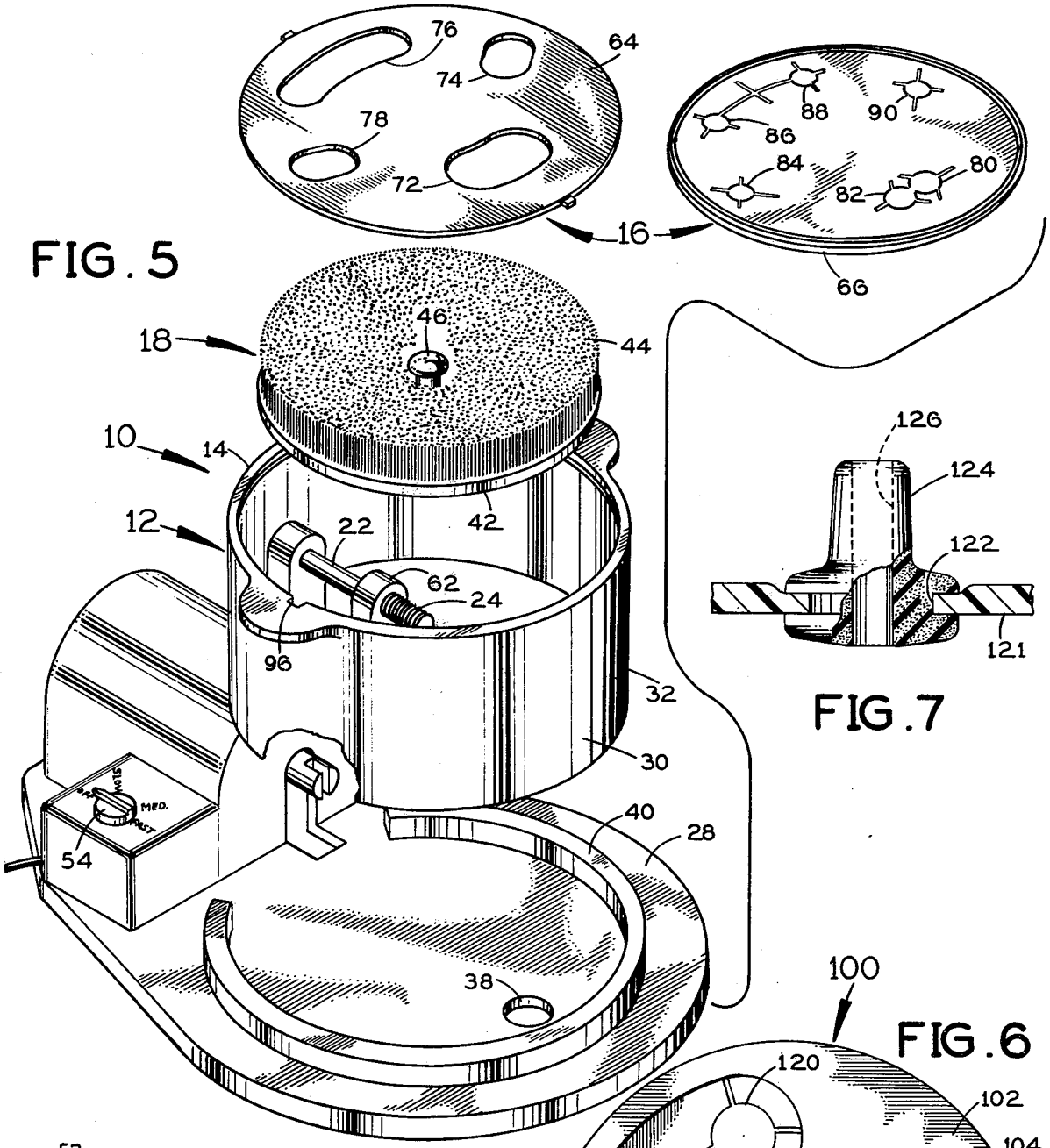
FIG. 5
FIG. 7
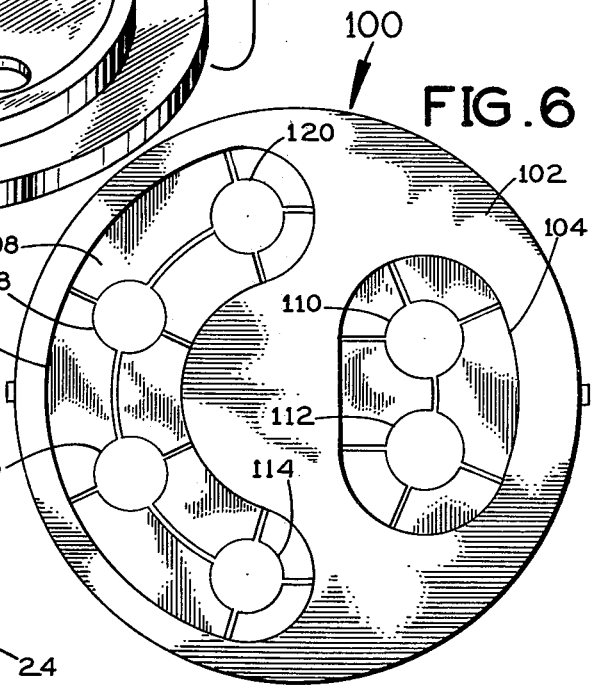
FIG. 6
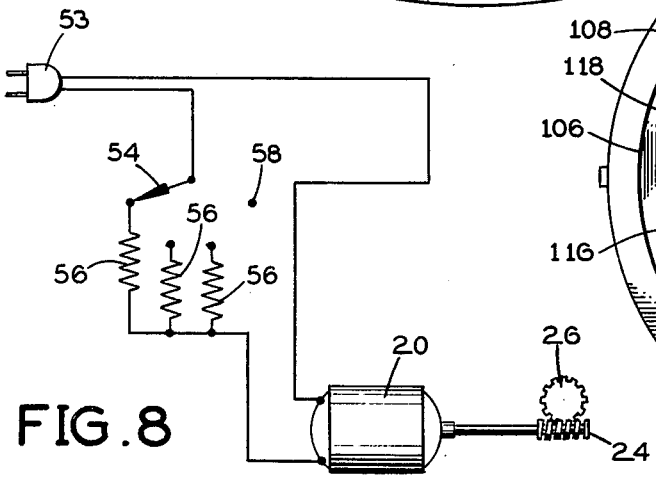
FIG. 8

FINGERNAIL CLEANING APPARATUS

BACKGROUND OF THE INVENTION

Fingernail cleaning devices have been proposed before, for example, in U.S. Pat. No. 3,982,965. Such fingernail cleaning devices have relied on the action of water jets to clean the fingernails.

SUMMARY OF THE INVENTION

The present invention utilizes brushing of fingernails while wet to obtain cleaning action, and particularly rotary brushing action. The apparatus includes a housing, a guide assembly forming finger entrances for the housing to receive fingers in the housing, a brush supported rotatably within the housing for brushing the nails of fingers inserted in the finger entrances, and a motor for driving the brush rotationally. The housing receives cleaning liquid such as water and soap solution, and the rotary brush brushes the nails while they are received in the cleaning solution to obtain excellent cleaning action. The guide assembly includes sealing structure for sealing around each finger to prevent the escape of liquid. One advantage is that all fingernails on one hand can be cleaned simultaneously.

Accordingly, it is an object of the present invention to provide a fingernail cleaning apparatus which utilizes brushing action to clean the fingernails.

Another object of the invention is to provide a rotary brush and fingernail cleaning apparatus which cleans the fingernails by rotary brushing action.

Another object of the invention is to provide a fingernail cleaning apparatus which will clean all of the fingernails on one hand simultaneously.

A further object of the invention is to combine brushing action with the action of cleaning liquid in a fingernail cleaning apparatus.

Other objects of this invention will appear from the following description and appended claims, reference being had to the accompanying drawings forming a part of this specification wherein like reference characters designate corresponding parts in the several views.

BRIEF DESCRIPTION OF DRAWINGS

FIG. 1 is a perspective view of a fingernail cleaning apparatus in accordance with one embodiment of the invention;

FIG. 2 is a vertical sectional view taken along line 2—2 of FIG. 1;

FIG. 3 is a top plan view, partially cut away, of the apparatus;

FIG. 4 is a fragmentary sectional view taken along line 4—4 of FIG. 2;

FIG. 5 is an exploded view of the fingernail cleaning apparatus of FIG. 1;

FIG. 6 is a top plan view of an alternate configuration for a guide assembly included in the apparatus;

FIG. 7 is a fragmentary view of an alternate sealing arrangement for the finger openings of the apparatus; and FIG. 8 is a schematic circuit diagram of a control for a motor of the apparatus.

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

DETAILED DESCRIPTION

Referring first to the FIGS. 1 through 5, the fingernail cleaning apparatus 10 includes a housing 12 for receiving liquid such as a water-soap solution in the interior thereof. The housing has a mouth 14, and a guide assembly 16 closes the mouth 14 except for finger openings which will be described. Within the housing 12, there is a rotary brush 18 for cleaning the nails of fingers inserted through the finger openings in the guide assembly 16. The rotary brushing action combined with the action of the cleaning liquid provides excellent cleaning action for the fingernails. The rotary brush 18 is driven by an electric motor 20 which is connected to the brush by a shaft 22 and gears 24 and 26.

The housing 12 includes a base plate 28 and a generally cup shaped member 30 affixed to the base plate 28. The cup shaped member 30 has a vertical side wall 32 terminating at the mouth 14 and a bottom wall 34 which carries a boss 36 that is received in an opening 38 in the base plate 28 for affixing the member 30 in a stationery position. The plate 28 has a curved ridge 40 which receives the side wall 32 of member 30.

The brush 18 includes a disc 42 on which the bristles 44 are mounted, and a shaft 46 which is journaled in a boss 48 extending up from the bottom 34. The shaft 46 may be snapped into the opening 50 in the boss 48 by means of a split ring 52.

The gear 26 is a pinion gear mounted on the shaft 46, and the gear 24 is a worm gear connected to the shaft 22 which in turn is driven by the motor 20. The motor 20 has a plug 53 for an electrical outlet. The motor 20 also has a speed control 54 which may have off, slow, medium, and fast settings, as shown in FIG. 3. As indicated in FIG. 8, the speed control 54 may be a rotary contact for cooperation with resistors 56 to provide the slow, medium, and fast settings and for cooperation with an open contact 58 to provide the off setting.

The shaft 22 is journaled in a bearing 60 mounted in the side wall 30 and passes through a projection 62 extending up from the bottom 34.

The guide assembly 16 includes a guide plate 64 and a resilient or flexible sealing member 66 abutting against the guide plate 64. The guide plate 64 has a bent over rim 68, and the sealing member 66 has a bent over portion 70 which snaps onto the rim 68. The sealing member 66 is preferably made of rubber, and the guide plate 64 is preferably made of plastic.

In the embodiment shown in FIGS. 1 through 5, the guide plate 64 has four openings 72, 74, 76, and 78 for receiving fingers. The sealing member 66 partially closes these openings, but forms smaller split openings, 80, 82, 84, 86, 88 and 90. The openings 80 and 82 form alternate entrances for receiving either the thumb of the right hand or the thumb of the left hand. The openings 84, 86, 88 and 90 receive either the four other fingers of the right hand or the four other fingers of the left hand. Thus, there are at least five openings, preferably six openings, in the sealing member 66, and the material around these openings is split so as to seal firmly against each finger inserted in the openings. All fingers of one hand may be cleaned at one time including the thumb. The sealing members prevent the escape of liquid from the housing to minimize splashing.

The guide plate 64 has tabs 92 and 94 which may be inserted into slots 96 and 98, and then the plate 64 may be rotated with the tabs 92 and 94 received in corresponding grooves.

FIG. 6 shows an alternate guide assembly 100. In this assembly, the guide plate 102 has only two openings 104 and 106. However, the sealing member 108 forms six openings just as in the previous description, the openings being denoted 110, 112, 114, 116, 118 and 120. The latter openings are split as shown to provide sealing action against the fingers. The openings 110 and 112 provide alternate thumb locations for the left and right hand.

FIG. 7 shows another possible modification wherein the guide plate 121 has an opening 122, and the sealing means is in the form of a sealing grommet 124 having a central opening 126 for receiving a finger. When sealing grommets are utilized in the manner illustrated in FIG. 7, a separate sealing grommet is provided for each finger opening in the guide member 120. The grommet 124 may be made of foam rubber or other spongy material to provide good sealing action around the fingers.

Thus, the invention provides an effective finger cleaning apparatus in which excellent cleaning action is obtained by means of a rotary brush combined with the action of cleaning liquid. All fingers of one hand may be cleaned at the same time. Alternate thumb locations are provided to make it convenient to clean either the right hand or the left hand.

Having thus described our invention, we claim:

1. A fingernail cleaning apparatus comprising:

a housing for receiving liquid;

disc-shaped brush means supported rotatably in a substantially horizontal plane within said housing for brushing fingernails while wet with said liquid;

motor means operatively connected to said brush means for rotating said brush means about a central axis thereof;

and guide means forming finger entrances for said housing above said brush means to allow insertion of only fingers into said housing into contact with said brush means for cleaning the fingernails;

said finger entrances including four finger entrances on one lateral side of the axis of rotation of said brush means;

and a fifth finger entrance on the opposite lateral side of the axis of rotation of said brush means;

whereby four fingers of one hand may be inserted respectively in said four finger entrances for brushing the nail thereof across the width of the nail and the thumb of the same hand may be inserted in said fifth finger entrance at the same time for brushing the nail thereof across the width of the nail.

2. The apparatus of claim 1 in which:

said guide means includes a guide member having openings therein at said entrances for receiving the fingers;

and sealing means for sealing around each finger at said openings to inhibit escape of liquid from the housing.

3. The apparatus of claim 2 in which:

said guide member and said sealing means form a sixth entrance adjacent said fifth entrance for alternate thumb location.

4. The apparatus of claim 3 in which:

said guide member comprises an apertured plate;

and said sealing means comprises a flexible apertured member abutting said plate and having multiple finger sealing portions.

5. The apparatus of claim 3 in which:

said guide member comprises an apertured plate;

and said sealing means comprises a plurality of separate seals each providing sealing for a finger opening in said plate.

6. The apparatus as claimed in claim 3 in which:

said housing has a mouth;

and said guide means closes said mouth except at said openings.

7. The apparatus as claimed in claim 6 in which:

said guide means is releasably mounted on said housing at said mouth thereof.

8. The apparatus as claimed in claim 7 in which:

said housing includes a base and a side wall releasably affixed to said base.

* * * * *